US007597206B2

(12) United States Patent
Atkins et al.

(10) Patent No.: US 7,597,206 B2
(45) Date of Patent: Oct. 6, 2009

(54) CONTAINER WITH ONE-STEP CLOSING

(75) Inventors: Todd W. Atkins, Dansville, MI (US); Dean A. Garza, Williamston, MI (US)

(73) Assignee: Dart Container Corporation, Mason, MI (US)

( * ) Notice: Subject to any disclaimer, the term of this patent is extended or adjusted under 35 U.S.C. 154(b) by 533 days.

(21) Appl. No.: 10/908,003

(22) Filed: Apr. 25, 2005

(65) Prior Publication Data

US 2005/0247709 A1 Nov. 10, 2005

Related U.S. Application Data

(60) Provisional application No. 60/521,434, filed on Apr. 26, 2004.

(51) Int. Cl.
*B65D 6/28* (2006.01)
*B65D 45/16* (2006.01)

(52) U.S. Cl. ..... 220/4.23; 220/324

(58) Field of Classification Search ..... 220/4.23, 220/4.22, 839, 837, 836, 915.1, DIG. 10, 220/810, FOR. 195, FOR. 192, 818, 817; 206/541; 16/232, 231, 221; 292/DIG. 17
See application file for complete search history.

(56) References Cited

U.S. PATENT DOCUMENTS 505,480 A * 9/1893 Pietcher ..... 16/232
2,433,305 A * 12/1947 Talcott, Jr. ..... 16/371
3,451,580 A * 6/1969 Husby ..... 220/4.21
3,539,802 A * 11/1970 Garnett et al. ..... 362/434
3,786,982 A * 1/1974 Rakes et al. ..... 229/406
3,954,179 A 5/1976 Warmath
4,183,446 A * 1/1980 Davis ..... 220/4.23
4,300,700 A * 11/1981 Chang ..... 220/521
4,753,351 A * 6/1988 Guillin ..... 206/520
4,771,934 A * 9/1988 Kalmanides ..... 229/406
4,886,204 A * 12/1989 Kalmanides ..... 220/833
4,892,220 A 1/1990 Foos
4,893,850 A * 1/1990 Mizusawa ..... 292/128
5,046,659 A * 9/1991 Warburton ..... 220/4.22
5,094,355 A * 3/1992 Clark et al. ..... 220/4.23
5,169,014 A * 12/1992 Hexamer ..... 220/4.22
5,205,413 A * 4/1993 Cautereels et al. ..... 206/541
5,269,430 A * 12/1993 Schlaupitz et al. ..... 220/4.23
5,322,178 A 6/1994 Foos
5,339,973 A * 8/1994 Edwards et al. ..... 220/4.23
5,377,860 A 1/1995 Littlejohn et al.
5,405,009 A * 4/1995 Hackenbracht ..... 206/470

(Continued)

FOREIGN PATENT DOCUMENTS

DE 3916668 A1 * 12/1989

(Continued)

*Primary Examiner*—Anthony D Stashick
*Assistant Examiner*—Robert J Hicks
(74) *Attorney, Agent, or Firm*—McGarry Bair PC

(57) ABSTRACT

A clam-shell container comprising a cover hingedly connected to a tray, with both the cover and tray having cooperating structures that form a leak-proof seal when the clam-shell container is closed. The container and cooperating structures are formed such that the user can effect the formation of the leak-proof seal in a single step. The creation of the leak-proof seal preferably corresponds to the closing of the clam-shell container.

35 Claims, 12 Drawing Sheets

U.S. PATENT DOCUMENTS

| | | | | | |
|---|---|---|---|---|---|
| 5,411,140 | A | * | 5/1995 | Byer | 206/504 |
| 5,515,993 | A | * | 5/1996 | McManus | 220/4.23 |
| 5,586,677 | A | | 12/1996 | Foos | |
| 5,607,709 | A | * | 3/1997 | Fritz et al. | 426/106 |
| 5,693,388 | A | * | 12/1997 | Castner et al. | 428/35.7 |
| 5,725,122 | A | * | 3/1998 | Murphy et al. | 220/521 |
| 5,860,549 | A | | 1/1999 | Allers et al. | |
| 5,947,321 | A | * | 9/1999 | Vadney | 220/367.1 |
| 5,950,854 | A | * | 9/1999 | Rider et al. | 220/4.23 |
| 5,979,687 | A | | 11/1999 | Hayes et al. | |
| 6,047,819 | A | | 4/2000 | Borst et al. | |
| 6,170,696 | B1 | | 1/2001 | Tucker et al. | |
| 6,554,147 | B1 | * | 4/2003 | Maida et al. | 220/4.23 |
| 6,609,623 | B2 | * | 8/2003 | Chou | 220/4.23 |
| 6,625,955 | B2 | * | 9/2003 | Aylward | 53/412 |
| 6,644,494 | B2 | | 11/2003 | Hayes et al. | |
| 2001/0002268 | A1 | | 5/2001 | Hanson et al. | |
| 2004/0007582 | A1 | | 1/2004 | Lin | |
| 2004/0007583 | A1 | | 1/2004 | Lin | |

FOREIGN PATENT DOCUMENTS

| | | | | |
|---|---|---|---|---|
| EP | 0383677 | | | 8/1990 |
| EP | 0 724 530 | | | 8/1996 |
| FR | 2606748 | A | * | 5/1988 |
| GB | 1311617 | | | 3/1973 |
| GB | 2160510 | A | * | 12/1985 |
| GB | 2141102 | | | 3/2008 |
| JP | 05221476 | A | * | 8/1993 |
| JP | 06115558 | A | * | 4/1994 |
| JP | 8-72909 | | | 3/1996 |
| JP | 2002-240842 | | | 9/2002 |

* cited by examiner

CONTAINER WITH ONE-STEP CLOSING

CROSS-REFERENCE TO RELATED APPLICATION

This application claims priority from U.S. Provisional Application No. 60/521,434 filed on Apr. 26, 2004.

FIELD OF THE INVENTION

The invention relates to a recloseable clam-shell type container comprising a tray and cover hingedly mounted together. The invention further relates to a recloseable clam-shell type container wherein the cover can be closed relative to the tray and in one step. The invention also relates to a leak-proof seal being formed between the tray and the cover upon closing.

DESCRIPTION OF THE PROBLEM

Clam-shell type containers are commonly used in the food industry for transporting the food home by the consumer, especially in the ready-to-eat food industry and in the restaurant industry for packaging leftovers. The clam-shell food containers are very convenient in that they comprise a cover that is hingedly mounted to a tray, which provides for convenient storage by the food service provider and convenient operation by the user.

Clam shell containers are generally thermoformed from two types of material. One type of material is foam made by expanding a suitable thermoplastic, such as polystyrene. Another type of material is made from a non-expanded thermoplastic, such as oriented polystyrene (OPS) or polyethelyenetheraphalate (PET). The foam containers are best suited for applications where the insulating characteristics of the foam are of a high priority, such as when the food is to be maintained at temperature prior to serving. The non-expanded thermoplastic containers are best suited when forming a seal between the cover and the tray to prevent leakage is a high priority, such as when leftovers are being taken home from a restaurant. The non-expanded materials are much more suitable than the expanded materials for being easily formed into the cooperating complex shapes necessary for the cover and the tray to form a leak-proof seal when closed.

The leak-proof seal is generally formed by cooperating structures extending about the peripheral of the cover and the tray and must be snap-fit together to form the leak-proof seal. Since most clam-shell containers are multi-sided, most often rectangularly-shaped, with more sides than the user has hands, to form the leak-proof seal, the user must snap the cooperating structures along each of the sides, resulting in a multi-step closing process. Most consumers find the multi-step closing very inconvenient. More troubling is that the more steps that are required to form the leak-proof seal, the more likely it is that the consumer will forget one of the steps or improperly perform one of the steps, resulting in an improperly formed seal and permitting the leaking of the contents from the container.

It is desirable to have a clam-shell type container with a one-step closing to effect the creation of the leak-proof seal.

SUMMARY OF THE INVENTION

The invention relates to a one-piece thermoformed container for storing food items. The container comprises a tray defining a recess for storing food items and defining an open top for providing access to the recess, and a cover sized to close the open top of the tray. A hinge connects the tray and the cover for relative movement between an opened and a closed condition such that the tray and cover can be relatively moved to selectively close the tray with the cover. A first seal structure is provided on one of the tray and cover and has a polygonal shape, and a second seal structure provided on the other of the tray and cover and has an overall trapezoidal shape with a rear portion near the hinge and a front portion opposite the rear portion. The first and second seal structures cooperate to form a substantially liquid-tight peripheral seal between the tray and the cover about the tray recess when the tray and cover are in the closed condition, and the trapezoidal shape and polygonal shape are configured such that that application of a compression force between the first and second seal structures at spaced locations on the front portion of the second seal structure is the only step needed to complete the formation of the liquid-tight seal.

The polygonal shape can comprise a rear portion and front portion and the first and second seal structures can be shaped such that at least a portion of the front portion of the polygonal shape is located forward of the front portion of the trapezoidal shape and requiring the relative deflection between the front portions to move the cover into the closed condition. Both the polygonal shape and the trapezoidal shape can comprise opposing side portions extending between the rear portion and front portion, with at least one of the side portions of the polygonal shape having a crown that extends exteriorly of the corresponding side portion of the trapezoidal shape to require the relative deflection of the at least one of the side portions of the polygonal shape and the corresponding side portion of the trapezoidal shape to move the cover into the closed condition. The circumference of the first seal structure can be substantially the same as the circumference of the second seal structure.

The one of the first and second seal structures can comprise a peripheral shoulder and the other of the first and second seal structures can comprise a sealing facet against which the shoulder presses when the cover is in the closed condition to form the substantially liquid-tight seal about the periphery of the recess. A portion of the shoulder can deflect against the sealing facet. The shoulder can comprise a flat extending along at least one side portion of the one of the first and second seal structures. The one of the first and second seal structures can comprise a first peripheral facet opposite the shoulder and the other of the first and second seal structures can comprise a second peripheral facet opposite the sealing facet and first and second peripheral facets can abut each other to form a second peripheral substantially liquid-tight seal about the recess. The shoulder, sealing facet, first facet, and second facet can be configured such that sealing facet and second facet apply opposing pressing forces to the shoulder and first facet, respectively.

The hinge can be configured to locate the rear portion of the second seal structure relative to the rear portion of the first seal structure such that as the cover is rotated from the opened to the closed condition, the rear portion of the second seal structure contacts the rear portion of the first seal structure to form an axis of rotation for the subsequent movement of the cover to the closed condition. The hinge can be further configured to locate the rear portion of the second seal structure below the rear portion of the first seal structure.

The rear portion of the second seal structure is wider than the rear portion of the first seal structure. The polygonal shape and the trapezoidal shape can comprise rear corners at the junction of the side portions with the rear portion and front corners at the junction of the side portions with the front portions. The rear corners of the trapezoidal shape can have a radius greater than the rear corners of the polygonal shape.

The polygonal shape can be a rectangle. The tray can comprise a bottom wall and a peripheral wall extending upwardly from the bottom wall to define the recess, with the first seal structure extending from the peripheral wall. The peripheral wall can terminate in a peripheral flange and the first seal structure extends from the peripheral flange. The cover can comprise a top wall and a peripheral wall extending downwardly from the top wall and terminating in a peripheral flange, with the second seal structure extending from the peripheral flange of the cover.

A pair of spaced indicia can be provided to indicate the location for applying the compressive force. Each spaced indicia can comprise a mating projection and recess provided on one of the cover and tray, respectively. The projection and recess are configured to lock the cover to the tray when mated.

In another aspect, the invention relates to a one-piece thermoformed container for storing food items. The container comprises a tray defining a recess for storing food items and defining an open top for providing access to the recess and a cover sized to close the open top of the tray. A hinge connects the tray and the cover for relative movement between an opened and a closed condition such that the tray and cover can be relatively moved to selectively close the tray with the cover. A first seal structure is provided on one of the tray and cover and a second seal structure is provided on the other of the tray and cover, with the first and second seal structures cooperating with each other to form a peripheral seal between the cover and the tray about the recess when the cover is in the closed condition. The one of the first and second seal structures can comprise a peripheral shoulder and the other of the first and second seal structures can comprises a sealing facet against which the shoulder abuts when the cover is in the closed condition to form the substantially liquid-tight seal about the periphery of the recess.

A portion of the shoulder can deflect against the sealing facet. The one of the first and second seal structures can comprise a first peripheral facet opposite the shoulder and the other of the first and second seal structures can comprise a second peripheral facet opposite the sealing facet and the first and second peripheral facets abut each other to form a second peripheral substantially liquid-tight seal about the recess. The shoulder, sealing facet, first facet, and second facet are configured such that sealing facet and second facet apply opposing pressing forces to the shoulder and first facet, respectively.

Each of the first and second seal structures can comprise a pair of opposing side portions. The shoulder along the pair of opposing side portions of the one of the first and second seal structures can comprise a flat.

Each of the first and second seal structures can comprise a rear portion near the hinge. The hinge is configured to locate the rear portion of the second seal structure relative to the rear portion of the first seal structure such that as the cover is rotated from the opened to the closed condition, the rear portion of the second seal structure contacts the rear portion of the first seal structure to form an axis of rotation for the subsequent movement of the cover to the closed condition.

The hinge can be further configured to locate the rear portion of the second seal structure below the rear portion of the first seal structure. The rear portion of the second seal structure can be wider than the rear portion of the first seal structure.

Each of the first and second seal structures can comprise a front portion opposite the rear portion. A pair of spaced indicia can be located in proximity to the front portion to indicate the location where a compressive force can be applied to effect the cooperation of the first and second seal structures and form the substantially liquid-tight seal. Each spaced indicia can comprise a mating projection and recess provided on one of the cover and tray, respectively. The projection and recess can be configured to lock the cover to the tray when mated.

Each of the first and second seal structures can have a front portion, a rear portion, and opposing side portions extending between the front and rear portion, with the first seal structure having a trapezoidal shape and the second seal structure having a rectangular shape. The rear portion of the first seal structure can be wider the front portion of the first seal structure. The rear portion of the first seal structure can be wider than the rear portion of the second seal structure. The side portions of the second seal structure can have a crown that is deflected by the corresponding side portions of the first seal structure when the cover is moved into the closed condition. The front portion of the second seal structure can be shaped such that it is deflected by the front portion of the first seal structure when the cover is moved into the closed condition. The circumference of the first and second seal structures can be approximately equal.

DESCRIPTION OF THE PREFERRED EMBODIMENT

FIGS. 1-4 illustrate a clam-shell container 10 comprising a cover 12 and a tray 14, which are connected by a hinge 16. The clam-shell container 10 is operable between an open condition (FIG. 1) and a closed condition (FIG. 2) by rotating the cover 12 about the hinge 16 from an open position (FIG.

Figure 1:
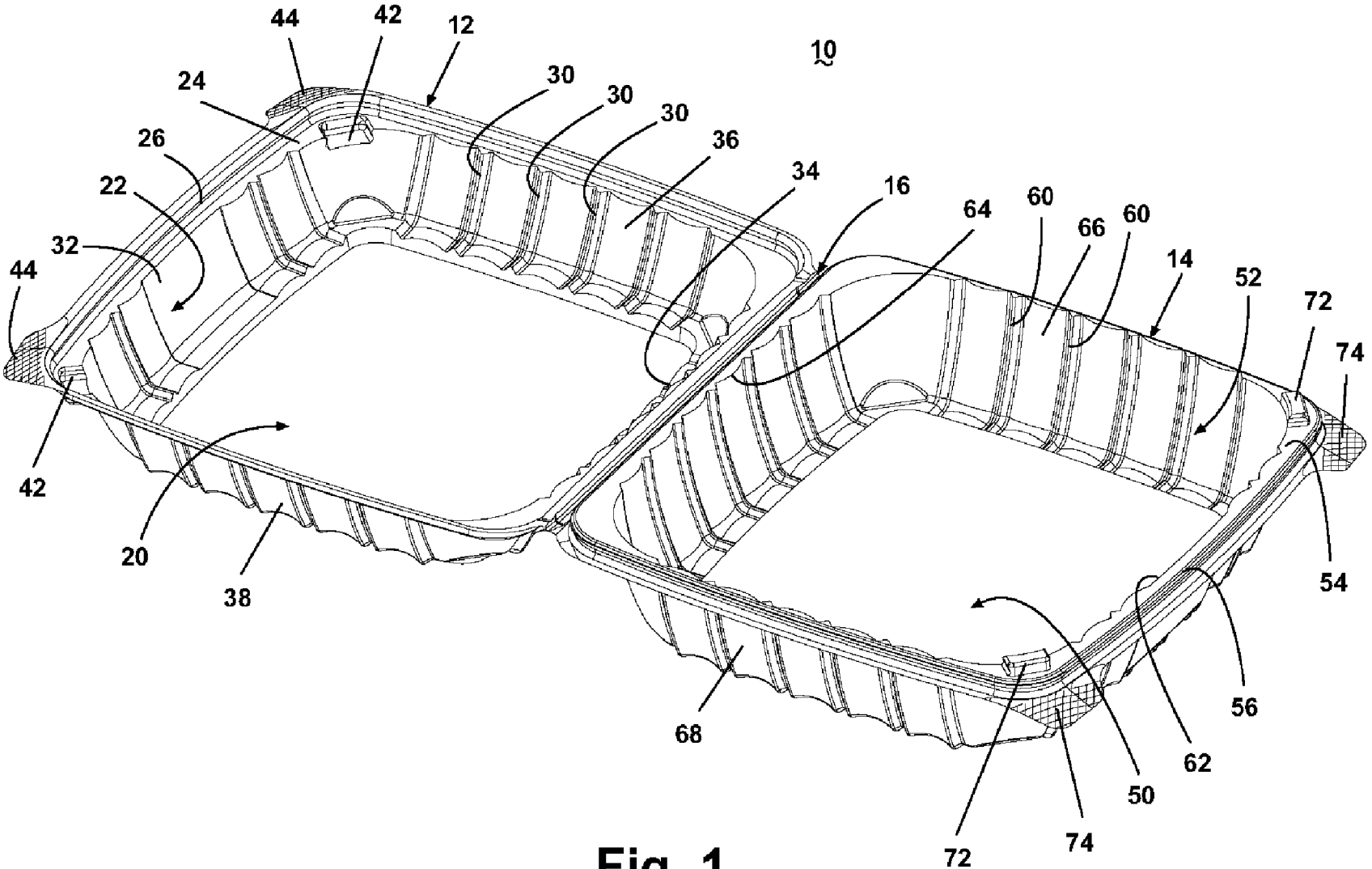
FIG. 1 is a perspective view of a clam-shell container according to the invention comprising a cover hingedly mounted to a tray, with the cover in an open position.
Figure 2:
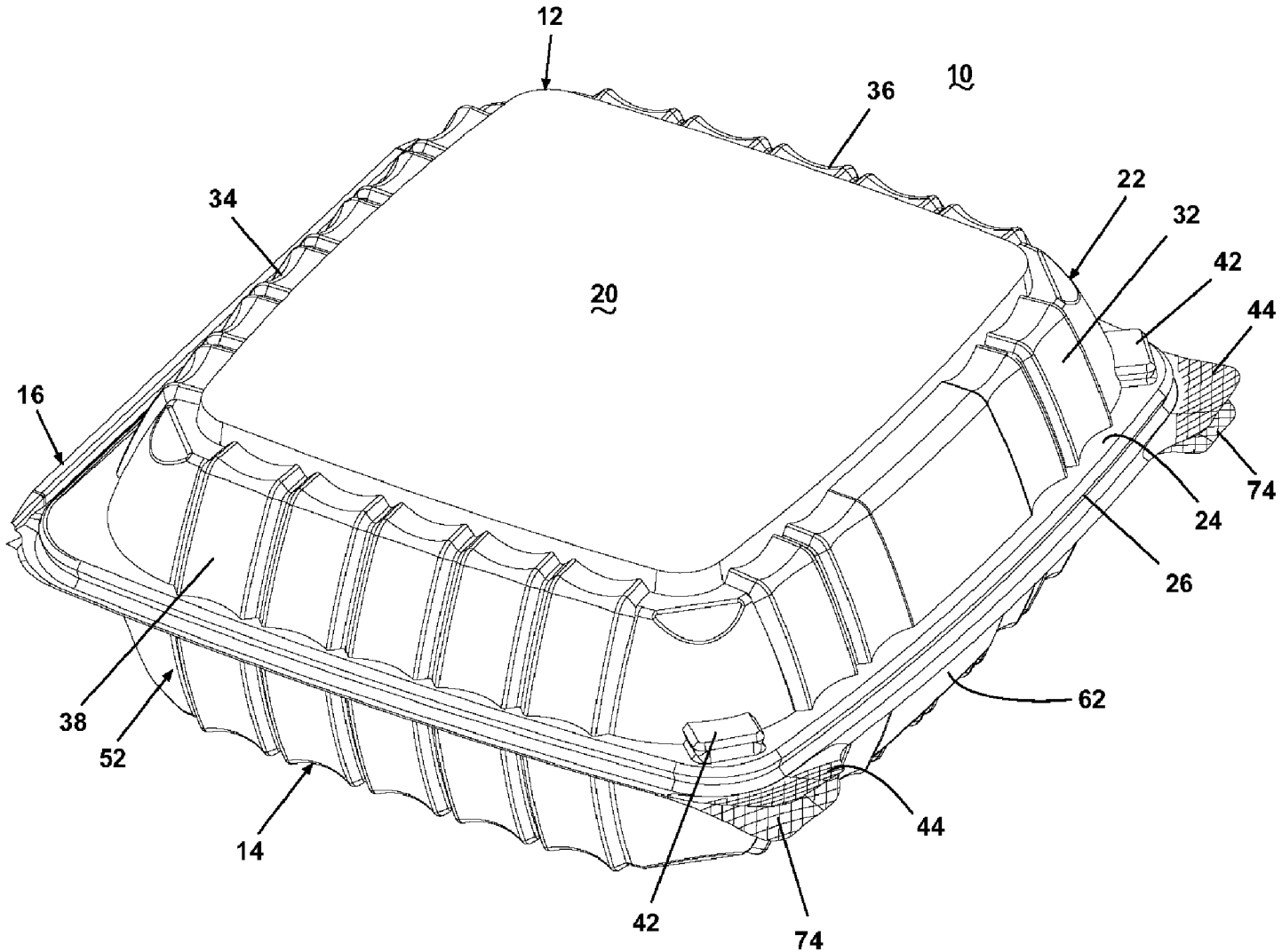
FIG. 2 is a perspective view of the clam-shell container of FIG. 1 with the cover in a closed position.

1) to a closed position (FIG. 2). The cover 12, tray 14, and hinge 16 are preferably integrally formed from a single piece of material in a well known thermoforming process. Suitable materials for the clam-shell container 10 include OPS and PET.

The cover 12 comprises a top 20 from which extends a peripheral sidewall 22, which terminates in a peripheral flange 24 and from which extends a cover seal structure 26. As illustrated, the top 20 comprises a substantially planar portion that steps down to the peripheral sidewall 22. However, the top 20 could have a more complex relief if desired.

The peripheral sidewall 22 is illustrated as having a generally vertical portion that transitions to a horizontal portion at the junction with the top 20. Multiple ribs 30 are provided in the peripheral sidewall 22 for strengthening. As illustrated, the peripheral sidewall 22 defines a rectangular shape comprising opposing front and rear sides 32, 34 and opposing lateral sides 36, 38, with the rear side 34 being located adjacent to and parallel with the hinge 16.

A pair of bar lock recesses 42 are formed in the peripheral flange 24. For the four-sided configuration illustrated in FIGS. 1-4, the bar lock recesses 42 are preferably located at the junction of the lateral sides 36, 38 with the front side 32. A pair of pull tabs 44 extend from the cover seal structure 26. The pull tabs 44 are preferably located along the cover seal structure 26 such that they correspond to the bar lock recesses 42 to aid in the opening of the clam-shell container 10 from the closed and sealed condition.

The tray 14 has the same general configuration as the cover 12. That is, the tray 14 comprises a bottom 50 from which extends a peripheral sidewall 52, which terminates in a peripheral flange 54 and from which extends a tray seal structure 56. As illustrated, the bottom 50 comprises a substantially planar portion that steps down to the peripheral sidewall 52. Like the top 20, the bottom 50 could have a more complex relief if desired.

The peripheral sidewall 52 is illustrated as having a generally vertical portion that transitions to a horizontal portion at the junction with the bottom 50. Multiple ribs 60 are provided in the peripheral sidewall 52 for strengthening. As illustrated, the peripheral sidewall 52 defines a rectangular shape comprising opposing front and rear sides 62, 64 and opposing lateral sides 66, 68, with the rear side 64 being located adjacent to and parallel with the hinge 16. In essence, the hinge 16 is formed in the material connecting the rear sides of the cover 12 and tray 14.

A pair of bar lock projections 72 are formed in the peripheral flange 54. For the four-sided configuration illustrated in FIGS. 1-4, the bar lock projections 72 are preferably located at the junction of the lateral sides 66, 68 with the front side 62, which will cause the bar lock projections 72 to be aligned with and received in the bar lock recesses 42 of the cover 12 when the clam-shell container 10 is in the closed condition. In this manner, the bar lock recess 42 and the bar lock projections collectively form a pair of bar locks for keeping the clam-shell container locked in the closed condition.

It should be noted that bar locks are well known for this purpose in the art. The particular type of bar lock used is not germane to the invention. In fact, the bar locks are not even necessary for the invention as the cooperating cover and tray seal structures 26, 56 are sufficient to hold the clam-shell container in the closed condition. Since users have become accustomed to the bar locks for identifying the location where the user should press the cover 12 and tray 14 to effect closure, the bar locks are provided as a visual indication for where the user needs to snap close the cover and tray seal structures 26, 56. The bar locks could be replaced with some other visual indication for the snap close location.

While the bar locks could be eliminated, the preferred embodiment does use the bar locks because they provide extra "holding power" in keeping the container closed. The holding power they provide is especially noticeable when the closed container has force applied to the sides. The bar locks help resist unintended openings when side force is applied.

A pair of pull tabs 74 extend from the cover seal structure 26. The pull tabs 44 are preferably located along the cover seal structure such that they correspond to the bar lock recesses to aid in the opening of the clam-shell container 10 from the closed and sealed condition.

Figure 5:
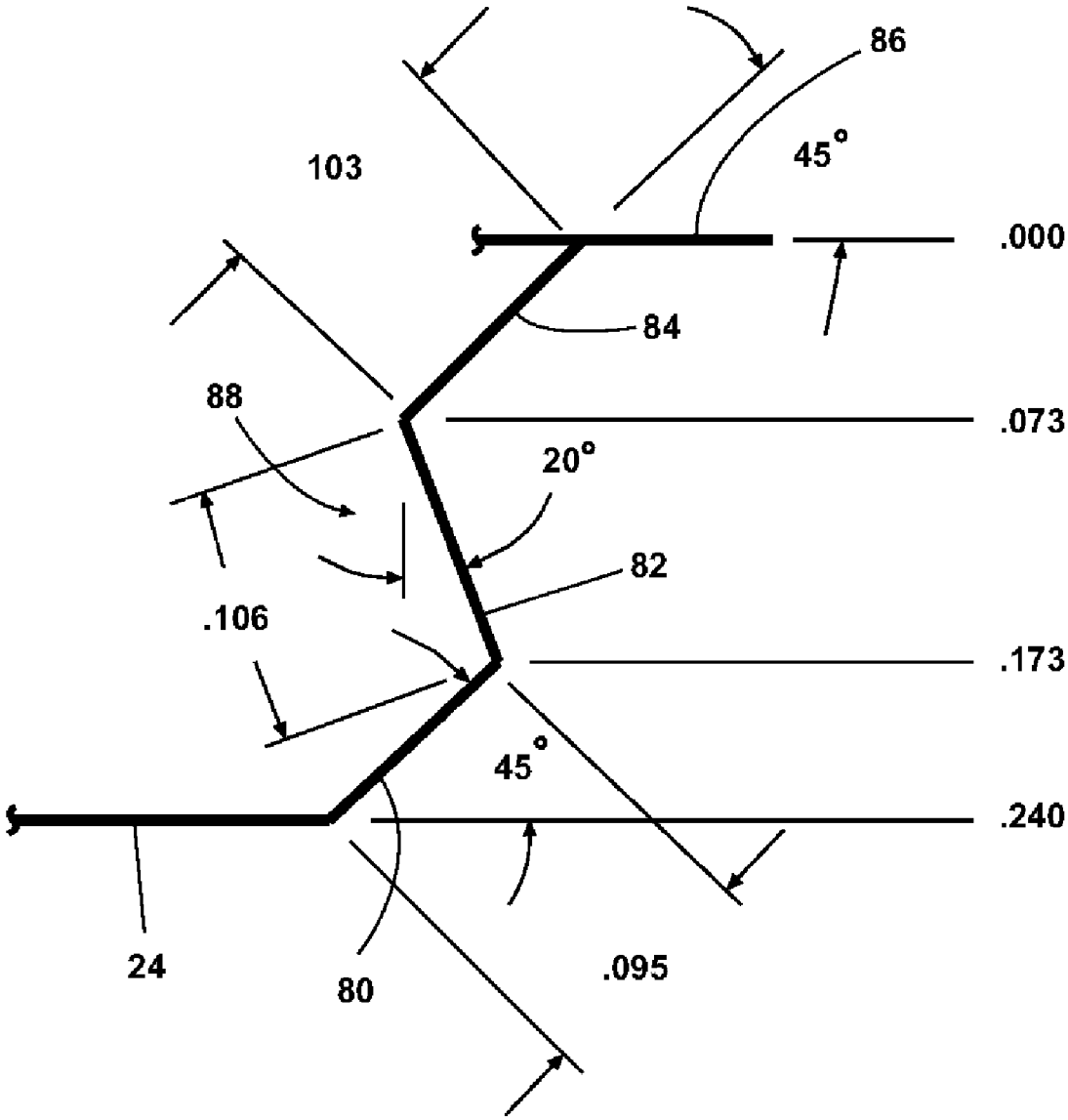
FIG. 5 is an enlarged sectional view of the cover taken along line 5-5 of FIG. 4 and illustrating in detail the cross-sectional shape of a cover seal structure.

The specific structure of the cover and tray seal structures 26, 56 will now be examined in greater detail. FIG. 5 illustrates the cross-sectional shape of the cover seal structure 26, which comprises three major annular facets 80, 82, and 84. A peripheral lip 86 extends laterally from the third facet 84. The first and second facets 80, 82 define an annular channel 88. The first facet 80 extends from peripheral flange 24 at a 45 degree angle relative to the vertical for a distance of 0.095 inches. The second facet 82 extends from the first facet 80 at a −20 degree angle relative to the vertical for 0.106 inches. The third facet 84 extends from the second facet 82 at and angle of 45 degrees relative to the vertical for 0.103 inches. The cross section of the cover seal structure is consistent around the periphery of the cover 12.

Figure 6:
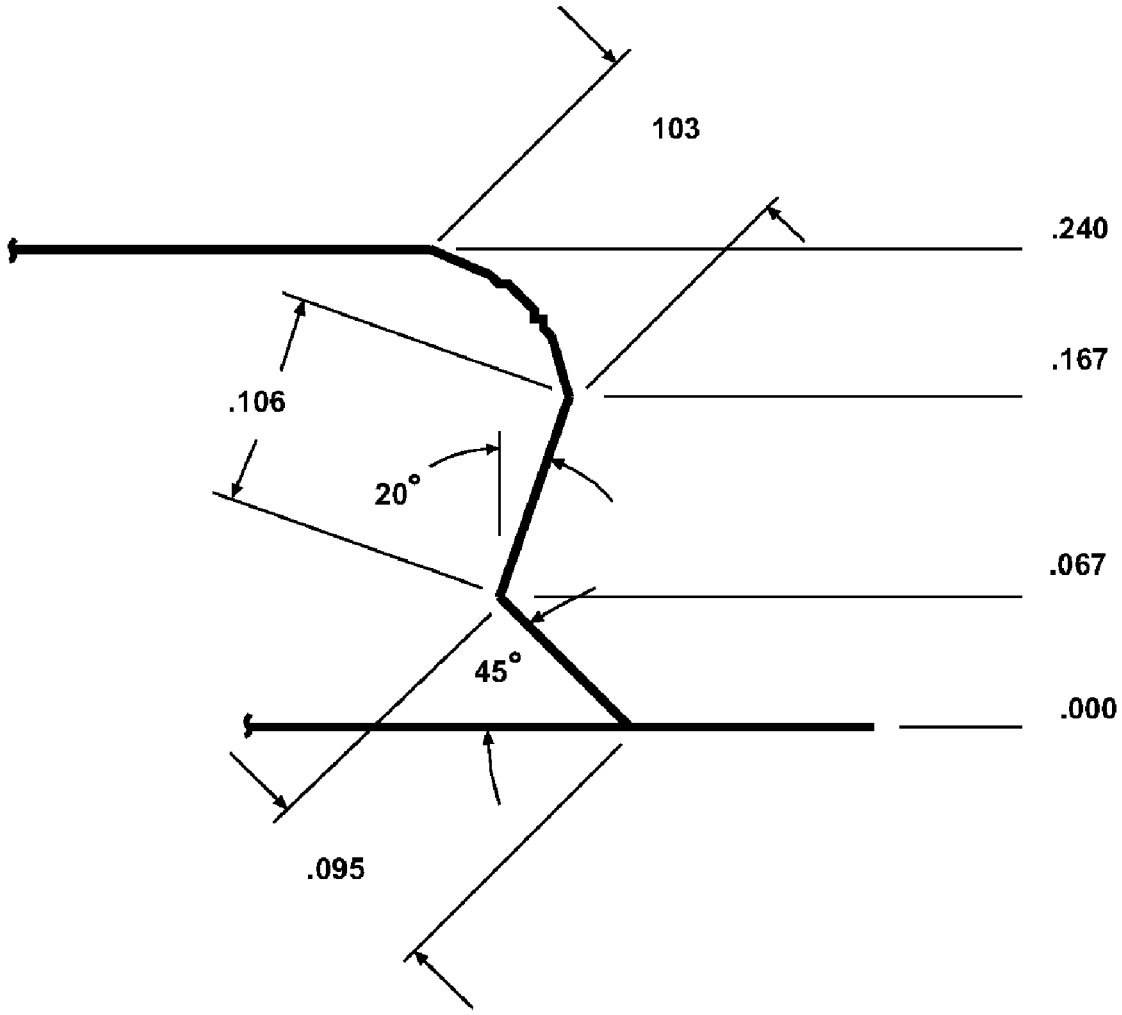
FIG. 6 is an enlarged sectional view of the tray taken along line 6-6 of FIG. 4 and illustrating in detail the cross-sectional shape of a tray seal structure along the front and back sides.
Figure 7:
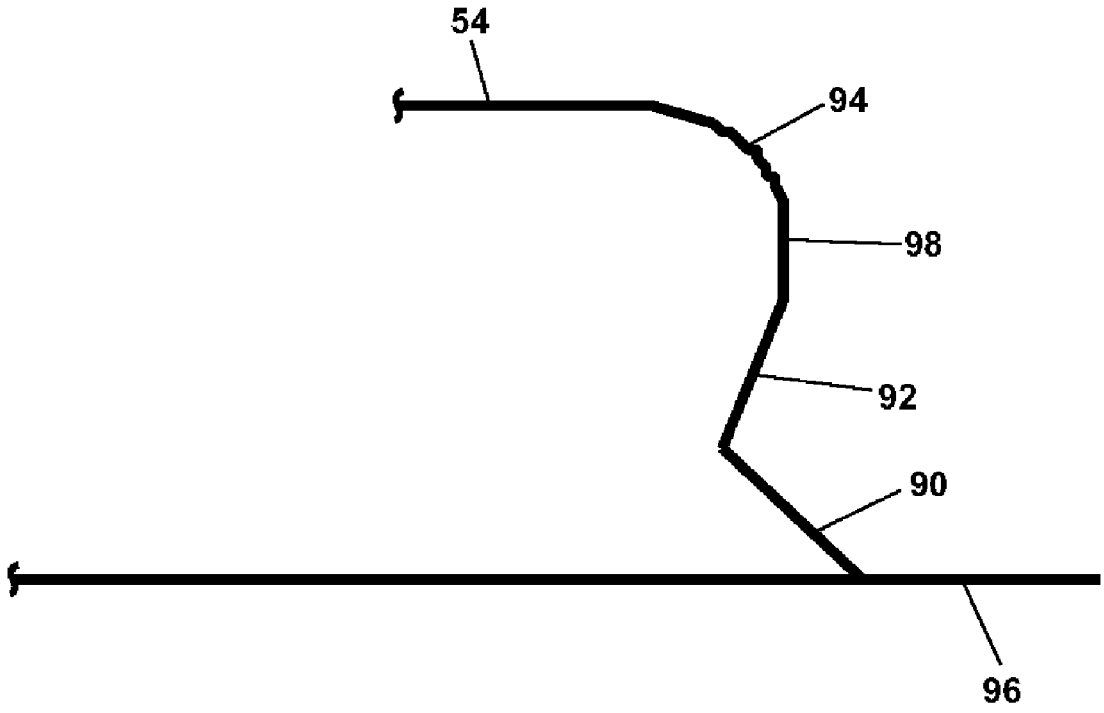
FIG. 7 is an enlarged sectional view of the tray taken along line 7-7 of FIG. 4 and illustrating in detail the cross-sectional shape of a tray seal structure along the lateral sides of the clam-shell container.
Figure 8:
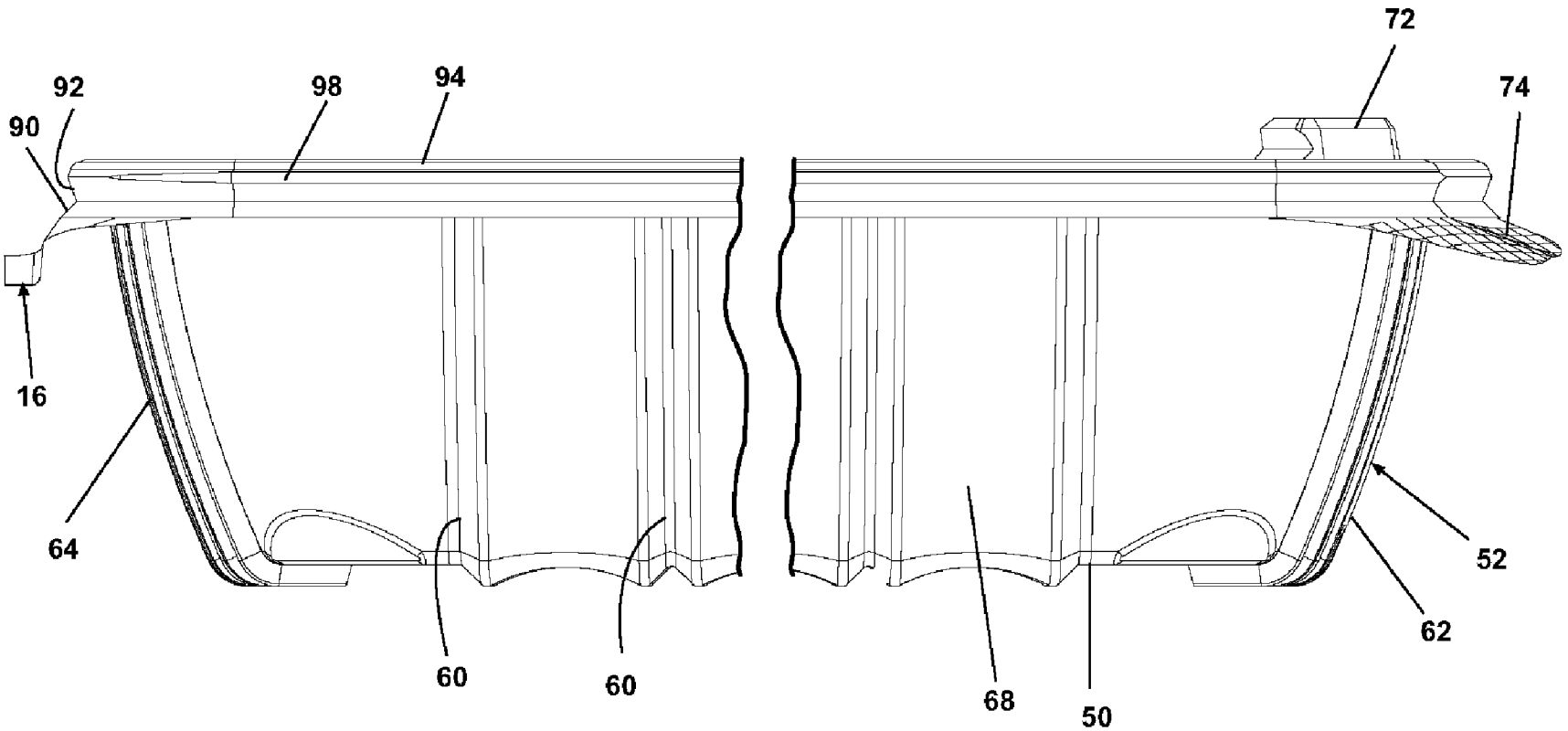
FIG. 8 is a broken and enlarged side view of the tray of the clam-shell container of FIG. 1 and illustrating in detail the portion of the seal structure along the lateral sides of the clam-shell container.

FIGS. 6-8 illustrate the cross-sectional shape of the tray seal structure. Unlike the cover 12, the tray seal structure 56 has two distinct cross-sectional shapes. FIG. 6 illustrates one of the cross-sectional shapes of the tray seal structure, which is primarily located along the front and rear sides 62, 64. This cross-sectional shape of the tray seal structure comprises two annular facets 90, 92 and a rounded portion 94. The first facet extends at an angle of −45 degrees from the vertical for a distance of 0.095 inches. The second facet extends at an angle of 20 degrees from the vertical for a distance of 0.106 inches. The rounded portion 94 spans a length of 0.103 inches. A peripheral lip 96 extends from the first facet 90.

FIGS. 7 and 8 illustrate the second cross-sectional shape for the tray seal structure 56. The second cross-sectional shape of the tray seal structure differs from the first cross-sectional shape of FIG. 6 in that a third facet 98 extends between the second facet 92 and the rounded portion 94. The third facet 98 is generally vertical. The addition of the third facet 98 necessarily shortens the extent of the rounded portion 94 and the second facet 92 as described in FIG. 6. As best seen in FIG. 8, the third facet 98 is essentially a flat that extends along a portion of the tray seal structure corresponding to the lateral sides 66, 68. The addition of the vertically-shaped third facet 98 has been found to improve the ability of the cover seal structure 26 to snap past tray seal structure 56 upon closing of the container.

Figure 9:
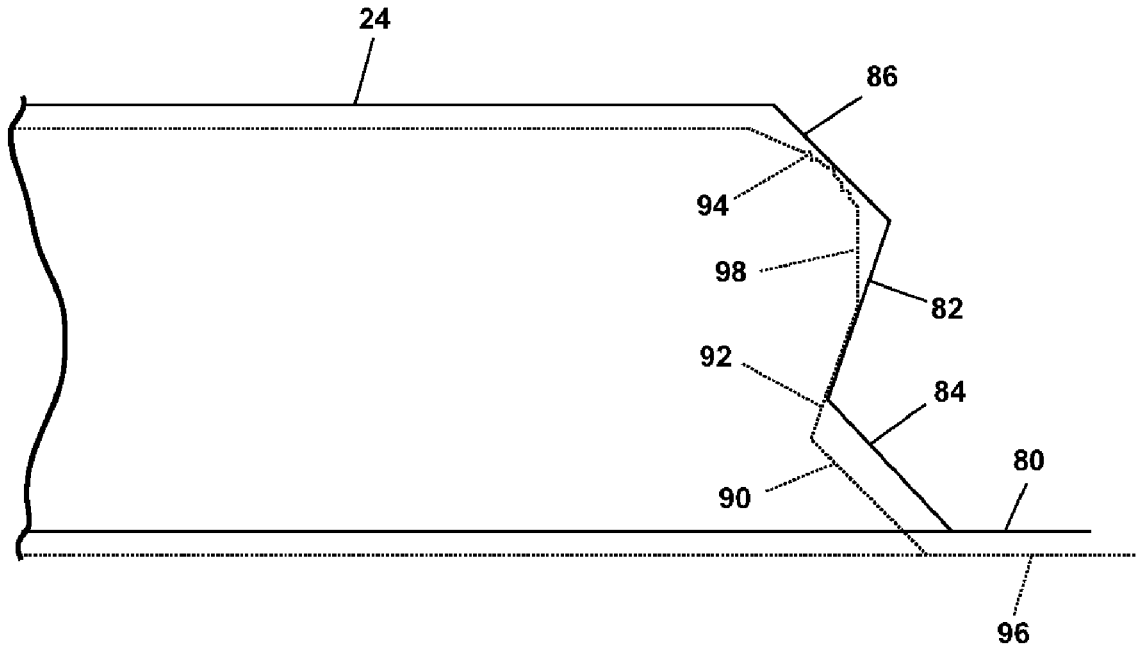
FIG. 9 is a schematic illustrating the interaction between the cover seal structure and the tray seal structure along the lateral sides of the clam-shell container in the closed position.

The interaction between the cover and tray seal structures 26, 56 when the clam-shell container 10 is in the closed condition is shown in FIG. 9. In the closed condition, there are two contact points between the cover and tray seal structures 26, 56. First, the rounded portion 94 of the tray seal structure 56 is located within the groove 88 such that it abuts the first facet 80 of the cover seal structure 26. In this manner, the rounded portion 94 functions much like an O-ring-like seal about the periphery of the cover 12 and tray 14. Second, the second facet 92 of the tray seal structure 56 abuts the second facet 82 of the cover seal structure 26. Similar contact between the cover seal structure 26 and the tray seal structure 56 exists along their entire interface.

Preferably, the spatial relationship between the first and second facets 80, 82 forming the groove 88 are such that they apply a compressive force across the rounded portion 94 and the second facet 92. This compressive force can be created by slightly undersizing the groove 88 and relying on the inherently resiliency of the material forming the first and second facets 80, 82.

Figure 10:
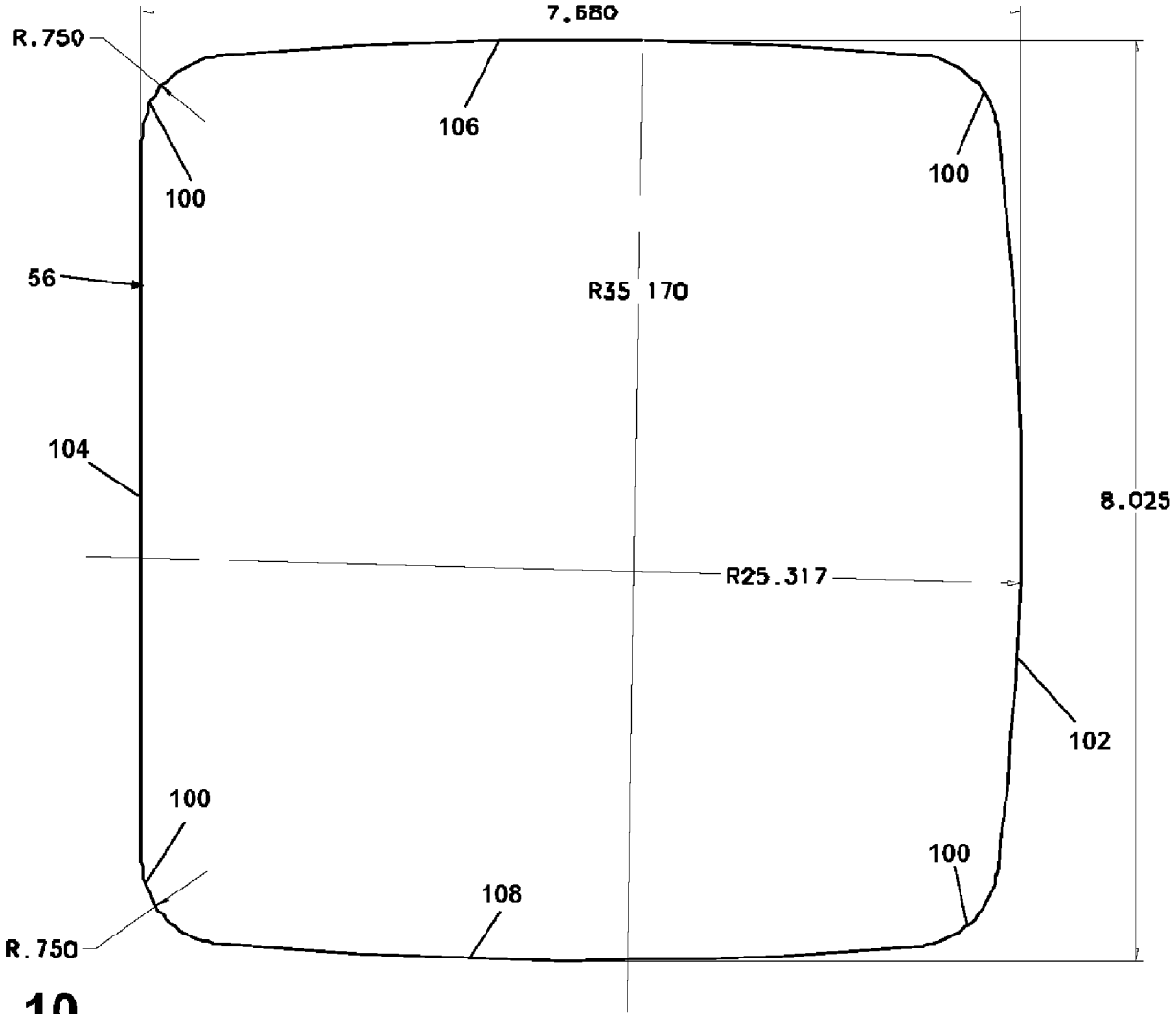
FIG. 10 is a schematic illustrating the peripheral shape of the tray seal structure and the corresponding dimensions.
Figure 11:
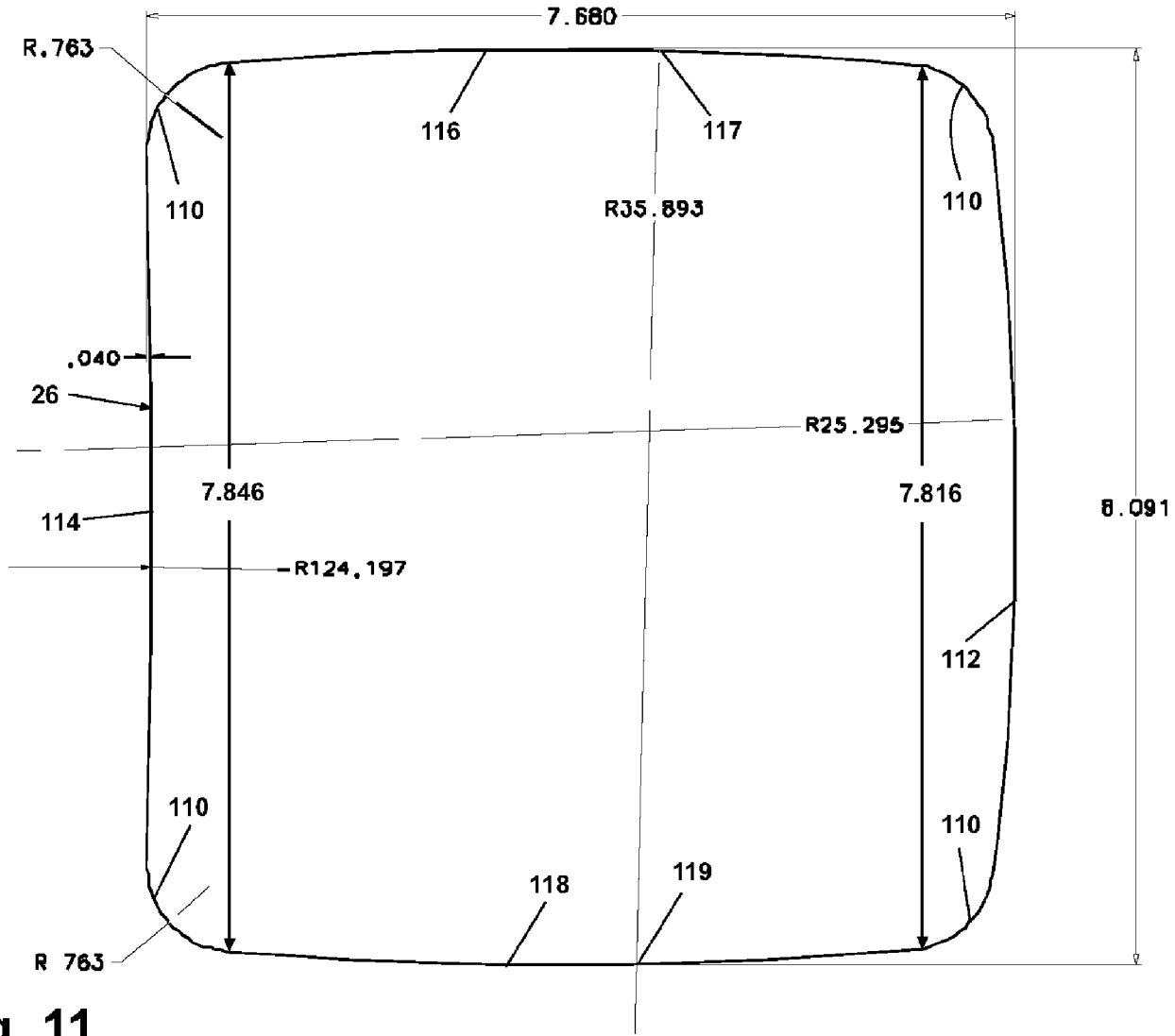
FIG. 11 is a schematic illustrating the peripheral shape of the cover seal structure and the corresponding dimensions.
Figure 12:
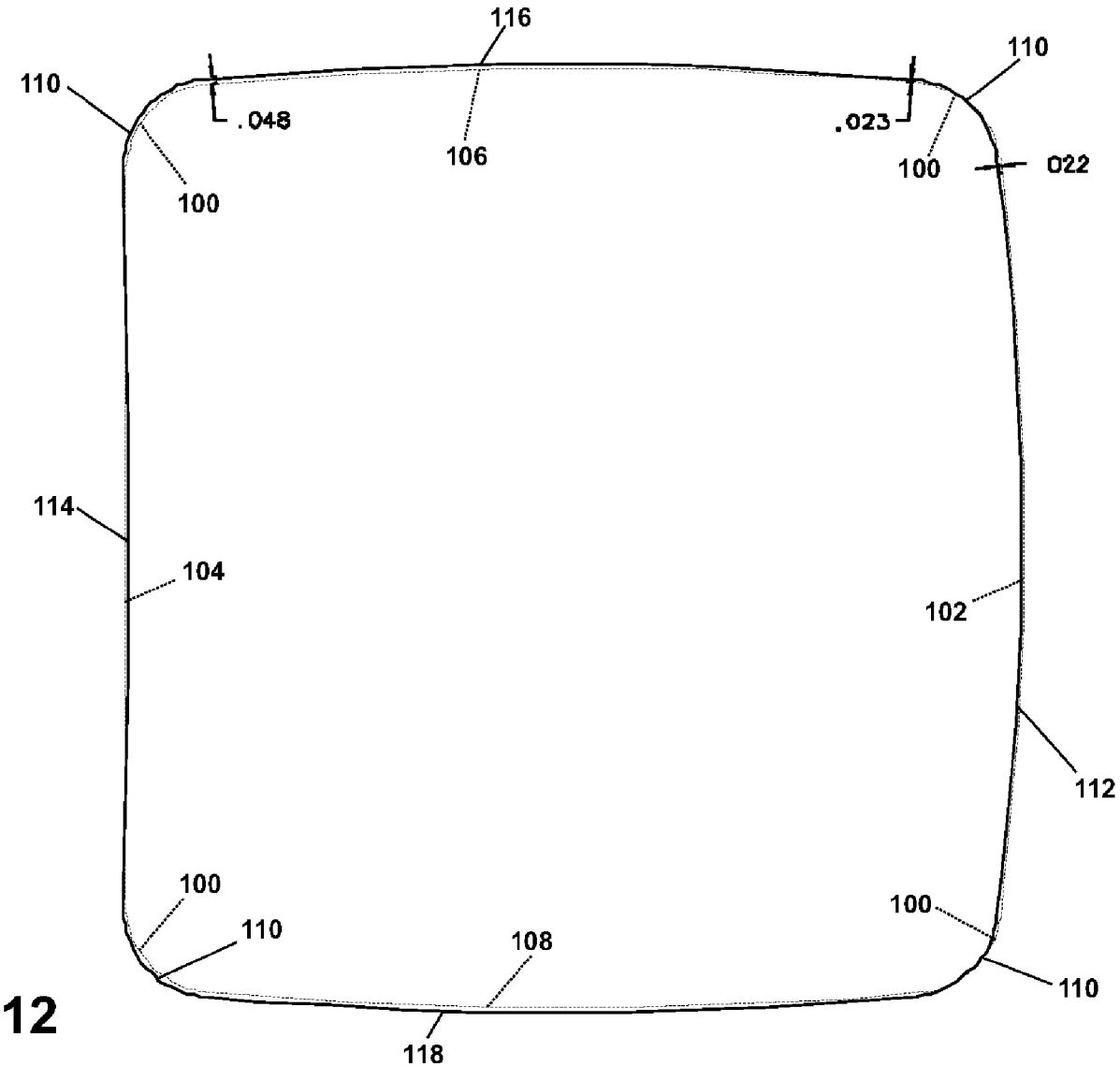
FIG. 12 is a schematic illustrating the peripheral shapes of the tray and seal structures of FIGS. 10 and 11 in overlying relationship.

FIGS. 10-12 illustrate the peripheral dimensions of the cover seal structure 26 and the tray seal structure 56 and their interaction when the clam-shell container 10 is in the closed condition. It should be noted that FIGS. 10-12 describe the "mold" side of the container and do not account for material thickness. When material thickness is accounted for the interference between the seal structures 26, 56 will be greater than illustrated.

FIG. 10 illustrates the peripheral dimensions of the tray seal structure 56. As can be seen, the tray seal structure generally follows the shape of the front 62, rear 64, and lateral sides 66, 68 of the tray 14 and comprises corners 100 connecting front 102, rear 104, and lateral 106, 108 portions of the tray seal structure 56. The corners have a radius of curvature of 0.750 inches, which is substantially smaller than prior art containers. The rear portion 104 is generally straight. The front portion 102 has a radius of curvature of 25.317 inches. The lateral portions 106, 108 each have a radius of curvature of 35.170 inches. With this configuration, the maximum length of the tray seal structure is 7.580 inches and the maximum width is 8.025 inches.

FIG. 11 illustrates the peripheral dimensions of the cover seal structure 26. Like the tray seal structure 56, the cover seal structure 26 generally follows the shape of the front 32, rear 34, and lateral sides 36, 38 of the cover 12 and comprises corners 110 connecting the front 112, rear 114, and lateral 116, 118 portions of the cover seal structure 26. The corners 110 have a radius of curvature of 0.763 inches, which is greater than the radius of curvature for the corners 100 of the tray seal structure 56 but still substantially smaller than prior art containers and greater. The rear portion 114 has a radius of curvature of 124.197. The front portion 112 has a radius of curvature of 25.295 inches. The lateral portions 116, 118 have a radius of curvature of 35.893 inches. With this configuration, the maximum length of the cover seal structure is 7.680 inches (same as the tray seal structure) and the maximum width is 8.091 inches (greater than the tray seal structure).

It can readily be seen that the cover seal structure 26 is wider along the rear portion 114 (7.846 inches) than the front portion 112 (7.816 inches). In this manner, the cover seal structure 26 can be thought of as having an overall trapezoidal shape with the wide portion being at the rear portion and the narrower portion being at the front portion.

The overall trapezoidal shape is not a true trapezoidal shape in that the lateral portions 116, 118 do not taper continuously from the rear portion 114 to the front portion 112. Instead, the lateral portions 116, 118 are arcuate and have a crown 117, 119, which lies closer to the front portion 112 than to the rear portion 114. From the rear portion 114 to the crowns 117, 119, the lateral portions 116, 118 actually diverge, instead of taper. From the crowns 117, 119 to the front portion 112 the lateral portions 116, 118 taper, with the magnitude of the taper being greater than the magnitude of the divergence, resulting in the overall trapezoidal shape.

The rear portion 114 of the cover seal structure curves into the interior of the cover whereas the front portion 112 and lateral portions 116, 118 curve away from the interior of the cover. In other words, when viewing from the interior of the cover, the rear portion 114 is convex and the front portion 112 and lateral portions 116, 118 are concave. The convex shape of the rear portion 114 aids in the positioning and coupling of the cover 12 to the tray 12 by improving the engagement of the cover rear portion 114 with the tray rear portion 104 upon closing.

FIG. 12 illustrates the dimensional differences of the tray and cover seal structures 56, 26 by laying them on top of each other. The corners 110 of the cover 12 are slightly larger than the corners 100 of the tray 14. While the front 112 and rear 114 portions of the cover 12 lie within the periphery of the tray 14, the lateral portions 116, 118 of the cover 12 lie exteriorly of the lateral portions 106, 108 of the tray.

It is worth noting that while the shapes of the cover and tray seal structures 26, 56 are different they both have approximately the same circumference. For example, the cover seal structure 26 has a circumference of 29.350 inches and the tray seal structure has a circumference of 29.232 inches.

In the prior art containers, there was a gap of approximately 0.022 inches between the tray seal structure 56 and the cover seal structure 26. FIG. 12 shows how this gap has changed with the current container. The gap along the lateral portions near the rear corners is 0.048 inches. The gap along the lateral portions near the front corners is 0.023 inches. Both of these dimensions are greater than the prior gap. The gap along the front portion near the corner is –0.022 inches. The negative gap results from the front portion of the tray seal structure extending beyond the front portion of the cover seal structure.

The shape of the cover and tray seal structures 26, 56 and spatial relationships resulting from the dimensional differences in the cover and tray seal structures 26, 56 are helpful in forming the leak-proof seal and providing the one-step closure. For purposes of the description, it is presumed that the cover 12 has been rotated about the hinge 16 until the cover 12 overlies the tray 14. Because the cover 12 is vertically offset from the tray 14, along the rear portions 104, 114 the second facet 82 of the cover seal structure 26 will necessarily be adjacent to and beneath the second facet of the tray seal structure 56. Conceptually, this can be thought of as the rear portion 114 of the cover sealing structure 26 being hooked to the rear portion 104 of the of the tray sealing structure 56. In addition to the vertical offset, the concave shape of the rear portion 114 of the cover aids in the engagement between the cover rear portion 114 and the tray rear portion 104. The convex shape creates a nose that is rotated beneath the rear portion 104 of the tray seal structure 56 upon rotation of the cover 12 and helps guide the remainder of the rear portion 114 beneath the rear portion 104.

From this starting position, the user can move the clam-shell container into a sealed and closed condition with a single step by pressing the bar lock projections 72 into the bar lock recesses 42. If the bar locks are not used, the user would just press in the same area. This action by the user causes the cover seal structure 26 to pivot about the tray seal structure 56 along the hooked rear portions 104, 114. As the cover seal structure 26 pivots, the corners 100 of the tray 14 are easily received with the larger-sized corners 110 of the cover 12. Similarly, the lateral portions 106, 108 are easily received within the lateral portions 116, 118. The flat created by the third facet 98 along the lateral portions 106, 108 of the tray seal structure 56 enhances the movement of the lateral portions 116, 118 of the cover seal structure 26 past the lateral portions 106, 108 of the tray seal structure 56.

This easy receipt of the tray seal structure 56 into the downwardly pivoting cover seal structure 26 continues until the corners 100 along the front portion 102 of the tray 16 are encountered. Since these corners 100 of the tray 16 and the front portion 102 of the tray 102 lie outside the periphery of the corresponding portions of the cover seal structure 26, the corresponding corners 110 and front portion 112 of the cover seal structure 26 must be deflected over the tray seal structure 56. Fortunately, the force applied the by user to the bar locks is sufficient for the necessary deflection to complete the encircling of the tray seal structure 56 by the cover seal structure 26 by forcing the corners 110 of the cover seal structure 26 and the front portion 112 over the corresponding portions of the tray seal structure 56.

Given that the cover and tray seal structures 26, 56 are made from resilient material and have a different shape but approximately the same circumference, the encircling of the tray seal structure 56 by the cover seal structure 26 essentially causes the cover and tray seal structures to conform to essentially the same common shape upon closing, resulting in the rounded portion 94 of the tray seal structure 56 filling in the channel 88 in the cover seal structure 26 and bearing against the first facet 80 to form a continuous O-ring-type seal about the periphery of the cover 12 and tray 14. Similarly, the second facet 92 of the tray seal structure 56 bears against the second facet 82 of the cover seal structure 26 to form a second peripheral seal.

Figure 3:
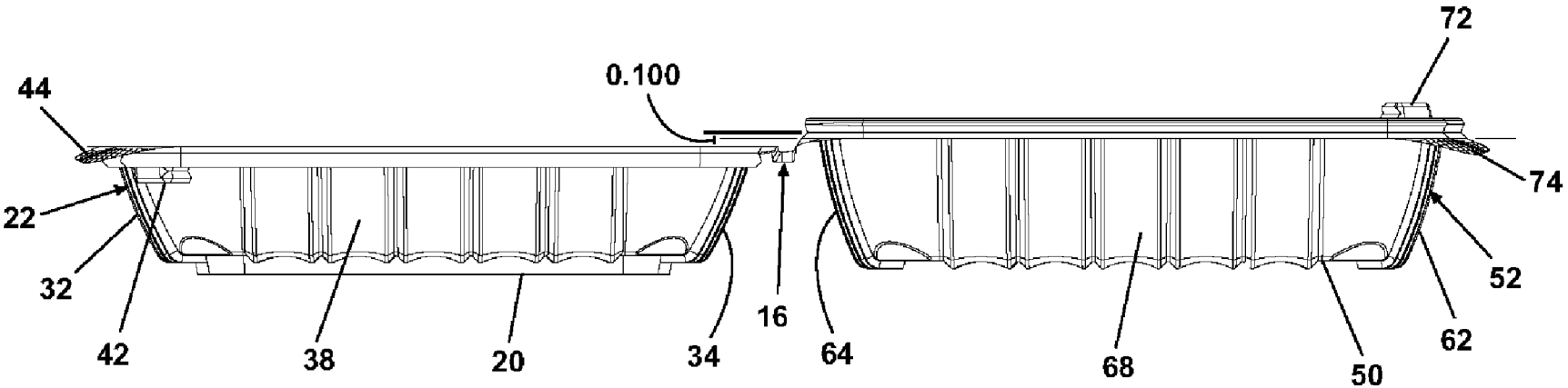
FIG. 3 is a longitudinal side view of the clam-shell container of FIG. 1.
Figure 4:
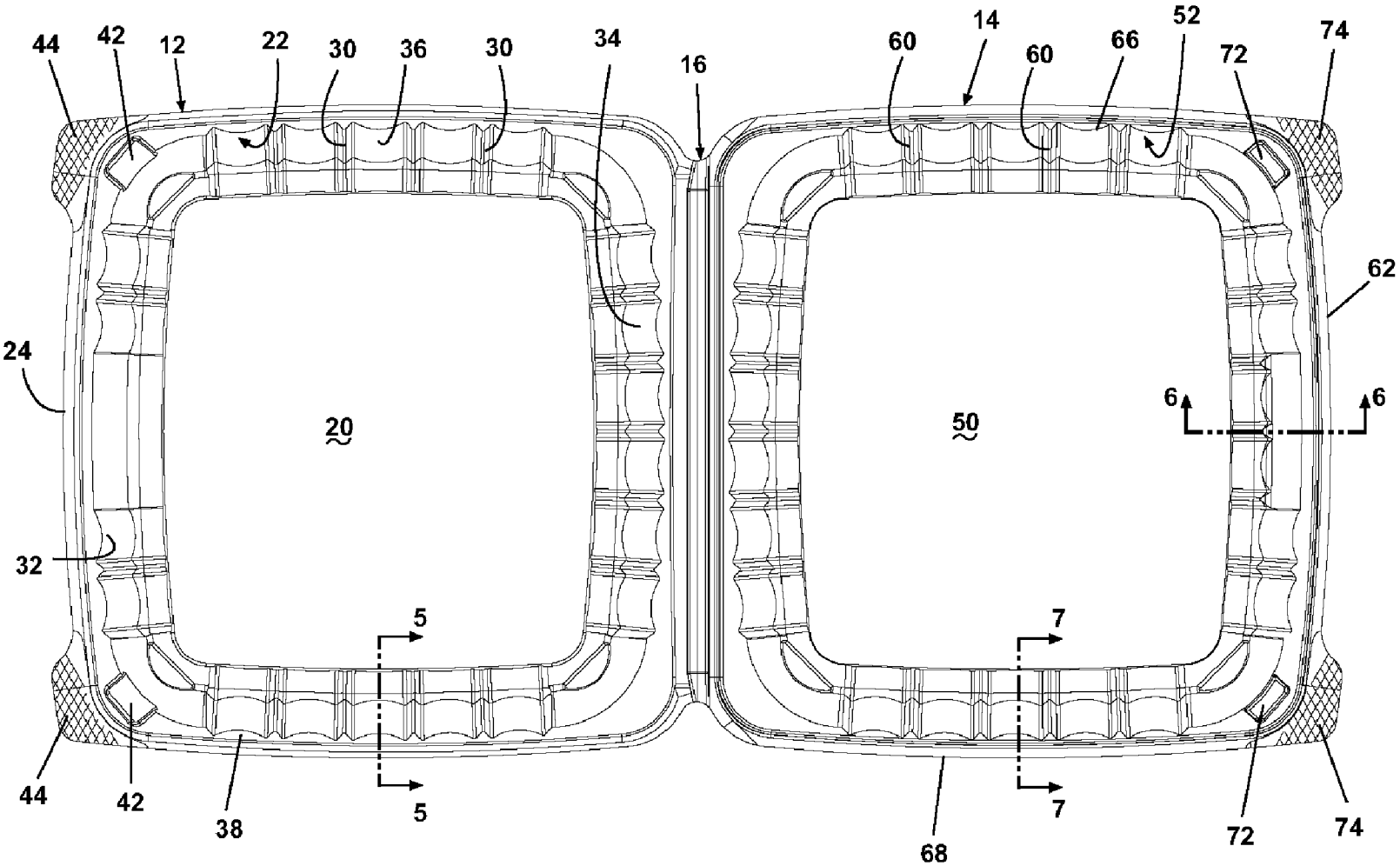
FIG. 4 is a top view of the clam-shell container of FIG. 1.

The ability for the user to close and seal the cover 12 to the tray 14 in one step is a great improvement over the prior art containers, which required multiple steps to effect the closing and seal creation. Several specific changes were made to the container to effect the one-step closing and sealing. The radius of the corners of the sealing structure, especially the corners along the hinge, was substantially reduced resulting in an increase of the hinge length. That is, the hinge extends along a greater extent of the container. The cover is vertically offset from the tray. This is done by locating the cover peripheral lip below the sheet line as illustrated in FIG. 3. The cover has an overall trapezoidal configuration. Finally, the circumference of the cover and seal structures were kept approximately the same even though they had different shapes.

What is claimed is:

1. A one-piece thermoformed container for storing food items, comprising:

a tray comprising a bottom wall from which extends a peripheral wall to define a recess for storing food items, with the peripheral wall terminating in a peripheral flange to define an open top for providing access to the recess; and a cover sized to close the open top of the tray and comprising a top wall terminating in a peripheral flange;

a hinge connecting the tray and the cover for relative movement between an opened and a closed condition such that the tray and cover can be relatively moved to selectively close the tray with the cover;

a first peripheral seal structure provided on the tray and circumscribing the recess and having a rear portion adjacent the hinge and a front portion opposite the rear portion, with the rear portion having a projection; and a second peripheral seal structure provided on the cover having a rear portion adjacent the hinge and having a front portion opposite the rear portion, with the rear portion having a projection, and the first and second peripheral seal structures cooperate to form a peripheral seal between the tray and the cover circumscribing the tray recess in the closed condition;

wherein the cover is vertically offset from the hinge such that the projection on the rear portion of the second peripheral seal is lower than the projection of the rear portion of the first peripheral seal in the opened condition, and the rear portion of the second peripheral seal structure is wider than the rear portion of the first peripheral seal structure, such that upon the relative rotation of the cover and tray, the projection on the rear portion of the second peripheral seal structure hooks with the projection on the rear portion of the first peripheral seal structure to form an axis of rotation therebetween for the subsequent movement of the cover to the closed condition and upon the application of a compression force between the front portions of the first and second seal structures a peripheral seal is formed around the recess to effect a one-step formation of the peripheral seal and thereby form a one-step closing container.

2. The one-piece thermoformed container according to claim 1, wherein the projections on the first and second peripheral seals are formed by intersecting facets.

3. The one-piece thermoformed container according to claim 2, wherein one of the first and second seal structures has an overall polygonal shape when viewed in planform and the other of the first and second seal structures has an overall trapezoidal shape when viewed in planform.

4. The one-piece thermoformed container according to claim 3, wherein the polygonal shape is a rectangle.

5. The one-piece thermoformed container according to claim 1, wherein the front portion of the first peripheral seal structure is located forward of the front portion of the second peripheral seal structure as the container is brought into the closed condition to require the relative deflection between the front portions to move the container into the closed condition.

6. The one-piece thermoformed container according to claim 5, wherein both the first and second peripheral seal structures comprise opposing side portions extending between the corresponding rear portion and front portion, with at least one of the side portions of the first peripheral seal structure having a crown that extends exteriorly of the corresponding side portion of the second peripheral seal structure to require the relative deflection of the at least one of the side portions of the first seal structure and the corresponding side portion of the second seal structure to move the container into the closed condition.

7. The one-piece thermoformed container according to claim 6, wherein the circumference of the first seal structure is substantially the same as the circumference of the second seal structure.

8. The one-piece thermoformed container according to claim 6, wherein one of the first and second seal structures comprises a peripheral shoulder and the other of the first and second seal structures comprises a sealing facet against which the shoulder presses when the cover is in the closed condition to form the substantially liquid-tight seal about the periphery of the recess.

9. The one-piece thermoformed container according to claim 8, wherein a portion of the shoulder deflects against the sealing facet.

10. The one-piece thermoformed container according to claim 8, wherein the shoulder comprises a flat extending along at least one side portion of the one of the first and second seal structures.

11. The one-piece thermoformed container according to claim 10, wherein the one of the first and second peripheral seal structures comprises a first peripheral facet opposite the shoulder and the other of the first and second peripheral seal structures comprises a second peripheral facet opposite the sealing facet and first and second peripheral facets abut each other to form a second peripheral substantially liquid-tight seal about the recess.

12. The one-piece thermoformed container according to claim 11, wherein the shoulder, sealing facet, first facet, and second facet are configured such that sealing facet and second facet apply opposing pressing forces to the shoulder and first facet, respectively.

13. A one-piece thermoformed container for storing food items, comprising:

a tray comprising a bottom wall from which extends a peripheral wall to define a recess for storing food items, with the peripheral wall terminating in a peripheral flange to define an open top for providing access to the recess; and a cover sized to close the open top of the tray and comprising a top wall terminating in a peripheral flange;

a hinge connecting the tray and the cover for relative movement between an opened and a closed condition such that the tray and cover can be relatively moved to selectively close the tray with the cover;

a first peripheral seal structure provided on the tray and circumscribing the recess and having a rear portion adjacent the hinge and a front portion opposite the rear portion, with the rear portion having a projection;

a second peripheral seal structure provided on the cover having a rear portion adjacent the hinge and having a front portion opposite the rear portion, with the rear portion having a projection, and the first and second peripheral seal structures cooperate to form a peripheral seal between the tray and the cover circumscribing the tray recess in the closed condition;

a bar lock comprising at least one complementary projection and recess, with the projection extending from at least one of the first and second peripheral seal structure and the recess extending below the other of the first and second peripheral seal structure such that projection is received within the recess in the closed condition; and wherein the cover is vertically offset from the hinge such that the projection on the rear portion of the second peripheral seal is lower than the projection of the rear portion of the first peripheral seal in the opened condition, and the rear portion of the second peripheral seal structure is wider than the rear portion of the first peripheral seal structure, such that upon the relative rotation of the cover and tray, the projection on the rear portion of the second peripheral seal structure hooks with the projection on the rear portion of the first peripheral seal structure to form an axis of rotation therebetween for the subsequent movement of the cover to the closed condition and upon the application of a compression force between the projection and recess a peripheral seal is formed around the recess to effect a one-step formation of the peripheral seal and thereby form a one-step closing container.

14. The one-piece thermoformed container according to claim 13, wherein the projections on the first and second peripheral seals are formed by intersecting facets.

15. The one-piece thermoformed container according to claim 13, wherein one of the first and second peripheral seal structures comprises a deformable rounded shoulder and the other of the first and second peripheral seal structures comprises a sealing facet against which the shoulder deforms when the cover is in the closed condition to form a substantially liquid-tight seal between the shoulder and the sealing facet.

16. The one-piece thermoformed container according to claim 15, wherein a portion of the shoulder deflects against the sealing facet.

17. The one-piece thermoformed container according to claim 15, wherein the one of the first and second peripheral seal structures comprises a first peripheral facet opposite the shoulder and the other of the first and second peripheral seal structures comprises a second peripheral facet opposite the sealing facet and the first and second peripheral facets abut each other to form a second peripheral substantially liquid-tight seal about the recess.

18. The one-piece thermoformed container according to claim 17, wherein the shoulder, sealing facet, first facet, and second facet are configured such that sealing facet and second facet apply opposing pressing forces to the shoulder and first facet, respectively.

19. The one-piece thermoformed container according to claim 18 wherein each of the first and second peripheral seal structures comprise a pair of opposing side portions.

20. The one-piece thermoformed container according to claim 19, wherein the shoulder along the pair of opposing side portions of the one of the first and second peripheral seal structures comprises a flat.

21. The one-piece thermoformed container according to claim 13, wherein each of the first and second peripheral seal structures comprises a rear portion near the hinge.

22. The one-piece thermoformed container according to claim 21, wherein the hinge is configured to locate the rear portion of the second peripheral seal structure relative to the rear portion of the first peripheral seal structure such that as the cover is rotated from the opened to the closed condition, the rear portion of the second peripheral seal structure contacts the rear portion of the first seal structure to form an axis of rotation for the subsequent movement of the cover to the closed condition.

23. The one-piece thermoformed container according to claim 22, wherein the hinge is further configured to locate the rear portion of the second peripheral seal structure below the rear portion of the first peripheral seal structure.

24. The one-piece thermoformed container according to claim 22, wherein the rear portion of the second peripheral seal structure is wider than the rear portion of the first peripheral seal structure.

25. The one-piece thermoformed container according to claim 21, wherein each of the first and second peripheral seal structures comprises a front portion opposite the rear portion.

26. The one-piece thermoformed container according to claim 25, and further comprising a pair of spaced indicia in proximity to the front portion and indicating the location where a compressive force can be applied to effect the cooperation of the first and second peripheral seal structures and form the substantially liquid-tight seal.

27. The one-piece thermoformed container according to claim 26, wherein each spaced indicia comprises a mating projection and recess provided on one of the cover and tray, respectively.

28. The one-piece thermoformed container according to claim 27, wherein the projection and recess are configured to lock the cover to the tray when mated.

29. The one-piece thermoformed container according to claim 13, wherein each of the first and second peripheral seal structures has a front portion, a rear portion, and opposing side portions extending between the front and rear portion, with the first peripheral seal structure having a trapezoidal shape and the second peripheral seal structure having a rectangular shape.

30. The one-piece thermoformed container according to claim 29, wherein the rear portion of the first peripheral seal structure is wider the front portion of the first peripheral seal structure.

31. The one-piece thermoformed container according to claim 30, wherein the rear portion of the first peripheral seal structure is wider than the rear portion of the second peripheral seal structure.

32. The one-piece thermoformed container according to claim 31, wherein the side portions of the second peripheral seal structure have a crown that is deflected by the corresponding side portions of the first peripheral seal structure when the cover is moved into the closed condition.

33. The one-piece thermoformed container according to claim 32, wherein the front portion of the second peripheral seal structure is shaped such that it is deflected by the front portion of the first peripheral seal structure when the cover is moved into the closed condition.

34. The one-piece thermoformed container according to claim 33, wherein the circumference of the first and second peripheral seal structures is approximately equal.

35. A one-piece thermoformed container for storing food items, comprising:

a tray comprising a bottom wall from which extends a peripheral wall to define a recess for storing food items, with the peripheral wall terminating in a peripheral flange to define an open top for providing access to the recess; and a cover sized to close the open top of the tray and comprising a top wall terminating in a peripheral flange;

a hinge connecting the tray and the cover for relative movement between an opened and a closed condition such that the tray and cover can be relatively moved to selectively close the tray with the cover;

a first peripheral seal structure provided on the tray and circumscribing the recess and having a rear portion adjacent the hinge and a front portion opposite the rear portion, with the rear portion having a projection; and a second peripheral seal structure provided on the cover having a rear portion adjacent the hinge and having a front portion opposite the rear portion, with the rear portion having a projection, and the first and second peripheral seal structures cooperate to form a peripheral seal between the tray and the cover circumscribing the tray recess in the closed condition;

wherein the cover is vertically offset from the hinge such that the projection on the rear portion of the second peripheral seal is lower than the projection of the rear portion of the first peripheral seal in the opened condition, such that upon the relative rotation of the cover and tray, the projection on the rear portion of the second peripheral seal structure hooks with the projection on the rear portion of the first peripheral seal structure to form an axis of rotation therebetween for the subsequent movement of the cover to the closed condition and upon the application of a compression force between the front portions of the first and second seal structures a peripheral seal is formed around the recess to effect a one-step formation of the peripheral seal and thereby form a one-step closing container.

* * * * *

UNITED STATES PATENT AND TRADEMARK OFFICE

CERTIFICATE OF CORRECTION

PATENT NO. : 7,597,206 B2
APPLICATION NO. : 10/908003
DATED : October 6, 2009
INVENTOR(S) : Atkins et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 676 days.

Signed and Sealed this

Twenty-eighth Day of September, 2010

David J. Kappos

David J. Kappos
*Director of the United States Patent and Trademark Office*